United States Patent [19]

Hurst

[11] 4,061,259

[45] Dec. 6, 1977

[54] ADJUSTABLE CARRYING CASE SYSTEM

[76] Inventor: Billy L. Hurst, 1016 Marton St., Laurel, Md. 20810

[21] Appl. No.: 727,640

[22] Filed: Sept. 29, 1976

[51] Int. Cl.[2] ..... B65D 71/00

[52] U.S. Cl. ..... 224/51; 190/60; 248/174; 248/359

[58] Field of Search ..... 224/50–58, 224/45 N; 190/60; 248/174, 359; 206/449, 450

[56] References Cited

U.S. PATENT DOCUMENTS

| | | | |
|---|---|---|---|
| 224,250 | 2/1880 | Tollner | 224/50 |
| 577,668 | 2/1897 | Stellner | 190/60 |
| 3,142,495 | 7/1964 | Lu | 281/29 |

FOREIGN PATENT DOCUMENTS

| | | | |
|---|---|---|---|
| 152,708 | 3/1938 | Austria. | |
| 858,877 | 12/1970 | Canada | 224/50 |
| 327,545 | 4/1930 | United Kingdom | 190/60 |

*Primary Examiner*—Robert J. Spar
*Assistant Examiner*—Donald W. Underwood
*Attorney, Agent, or Firm*—Morton J. Rosenberg

[57] ABSTRACT

An adjustable carrying case system which incorporates the use of at least one case being transported and having a handle member secured to an upper surface of the case for use in lifting the entire system by a user. The carrying case system includes at least a pair of transversely displaced opposing planar panels which are formed separate and distinct each from the other. In the operative mode, the case to be transported is inserted between opposing internal surfaces of the planar or panel members. At least one strap or belt member passes in tortuous path through the opposing panel members and interface with the case being carried at an upper surface and a lower surface thereof. The strap members are positionally located at a point to intersect the path of removal of the case being transported. The case is simultaneously releasably captured and supported between the opposing panel members in a transverse direction and between the endless loop strap in a vertical direction.

8 Claims, 3 Drawing Figures

ADJUSTABLE CARRYING CASE SYSTEM

BACKGROUND OF THE INVENTION

1. Field of the Invention

This invention pertains to carrying case systems for transporting cases. In particular, this invention relates to carrying case systems which incorporate the case to be transported as an important part of the carrying case system. Still further, this invention relates to an improved adjustable carrying case system that utilizes a pair of opposing planar members around which is passed a capturing and supporting belt to provide support and constrainment for the case being transported. More in particular, this invention pertains to carrying case systems which are adjustable and where a plurality of cases to be transported may be movably displaced by manual operation of the handle of one of the cases by an operator.

More in particular, this invention relates to adjustable carrying cases where intermediate panels may be utilized to provide a compartmentalized effect to carry a plurality of cases being segregated each into its own area of the carrying case system. More fully, this invention relates to an adjustable carrying case system having discrete panel sections which may be varied over a wide transverse direction dependent upon the width of cases being transported. Still further, this invention pertains to improved adjustable carrying case systems which are lightweight in construction and easily manipulatable by an operator.

2. Prior Art

Carrying case systems are well known in the art. In some prior systems such as those shown in U.S. Pat. Nos. 408,937; 941,212; and 2,038,890, there are provided clamping fixtures associated with opposing planar or panel sections. However, in such prior systems, the opposing sections are canvases or the objects being transported. Thus, such systems do not provide for external environment protection of the objects being displaced.

In some prior references, a strap or belt members are utilized for constrainment such as that shown in U.S. Pat. No. 2,912,151. However, in such prior references, the strap members do not pass through openings in the panels to provide for a maximum of friction effect and generally do not provide for constrainment of the belt members along the length of opposing planar panel members in the nature of the instant invention.

Still further, in other prior systems where belt members are utilized, such do not provide for constrainment of the article being displaced or transported as well as providing for support of the article during the operative phase of the carrying case system.

Still further, other prior carrying case systems do not utilize a case being transported as part of the system wherein the handle of the transported case becomes a carrying member of the system.

In other prior systems where opposing panel members are positioned to provide restrainment of an article being carried in a transverse direction, there is no provision made for the panels to be separate and distinct. Thus, in such systems, intermediate panels for compartmentalizing the entire system are not provided and such would have a derrogatory effect when relating to adjustability of size of such a carrying system.

SUMMARY OF THE INVENTION

An adjustable carrying case system comprising at least one case having a handle member affixed to an upper surface of the case. The system includes at least a pair of transversely displaced opposing planar members being separate and distinct each from the other. The case is insertable between opposing internal surfaces of the planar members and a mechanism for simultaneously releasably capturing and supporting the case between the opposing planar members and the capturing and supporting mechanism is provided.

It is an object of the invention to provide a lightweight, easily manufactured and low-cost improved carrying case system.

It is a further object of the instant invention to provide an improved carrying case system where the case being transported is an integral part of the transporting mechanism.

It is still further an object of this invention to provide an improved adjustable carrying case system which allows for a wide transverse direction manipulation to accommodate different widths of cases being displaced.

It is another object of the present invention to provide an improved adjustable carrying case system which captures and supports a case being transported through utilization of a strap member passing above and below the case being moved.

It is a still further object of the instant invention to provide an improved adjustable carrying case system which utilizes separate and distinct opposing transversely displaced panel members in combination with a strap member and the case being moved to provide a simple and easily manipulated system.

It is a still further object of the instant invention to provide an improved adjustable carrying case dystem which may accommodate a plurality of intermediate panels to segregate various cases being transported.

DESCRIPTION OF THE PREFERRED EMBODIMENTS

Figure 1:
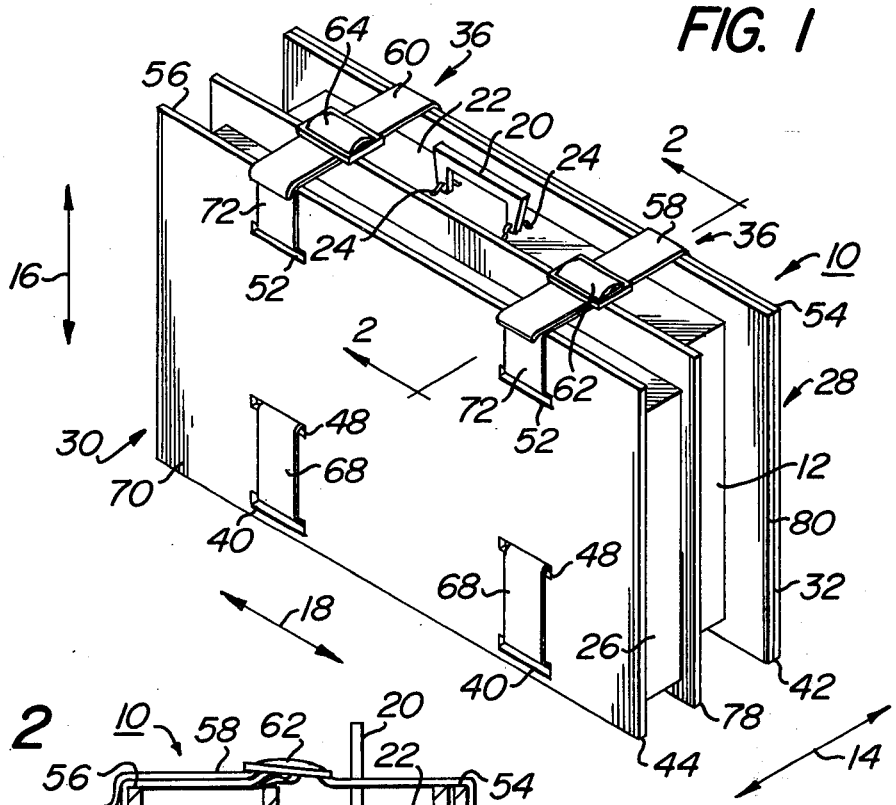
FIG. 1 is a perspective view of the adjustable carrying case system showing a pair of cases being transported.
Figure 2:
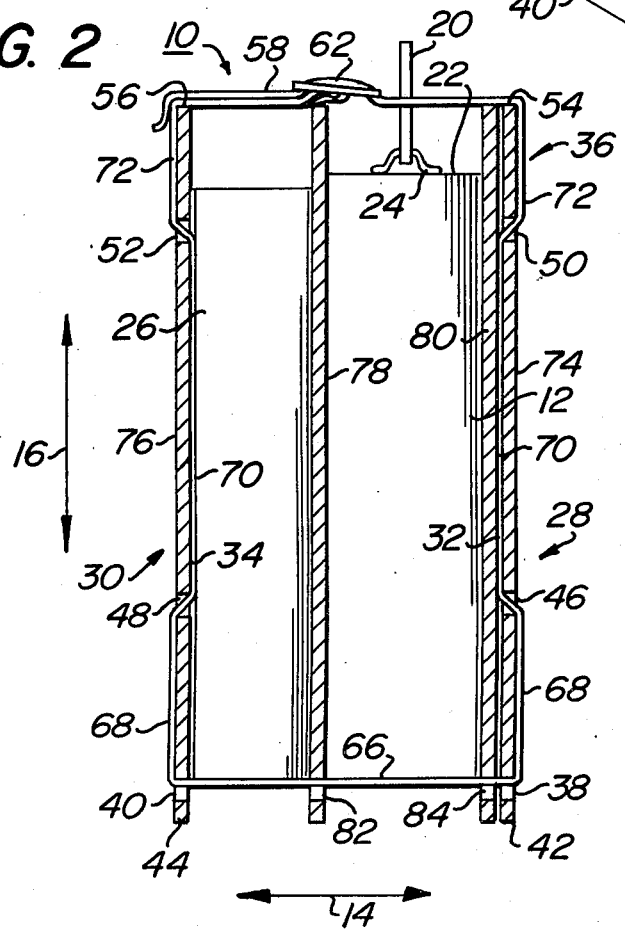
FIG. 2 is an elevational sectional view of the adjustable carrying case system taken along the section line 2—2 of FIG. 1.

Referring now to FIGS. 1 and 2, there is shown adjustable carrying case system 10 for constraining and supporting one or a plurality of cases 12. In overall concept, carrying system 10 provides the user with a carrying case which is light weight in construction, simple to operate, and adjustable in the transverse direction defined by directional arrow 14. Adjustability is important due to the fact that the user may thus utilize system 10 for a multiplicity of cases 12 having individual widths. In particular, adjustable carrying case system 10 may be utilized to carry display cases 12 and to protect such from external environment conditions. The display cases 12 in themselves may be fragile in nature or contain objects which are easily broken, and system 10 is devised to protect such from impact loading sufficient to injuriously damage either the cases 12 or contents contained therein. Still further, carrying case system 10 allows the user to carry a plurality of cases 12 with one hand while protecting cases from external impact loading and as will be shown in following paragraphs also protect cases 12 each from the other during transport. System 10 provides for support of each of cases 12 while at the same time providing for a capture of cases 12 during the transport mode of operation.

In general, adjustable carrying case system 10 utilizes in itself at least one case 12 having handle member 20 affixed to upper surface 22 of case 12. Handle 20 may be of a type which is well known in the art and may be used in conjunction with system 10 or when case 12 is removed from carrying case system 10. Handle 20 may be affixed to case 12 through handle brackets 24 which are secured to upper surface 22 through bolting, screw members, or some like means not important to the inventive concept as is herein described.

As will be shown in following paragraphs, other display cases 26 may be captured and supported within carrying case system 10 and may or may not include handles. The important aspect being that at least one case 12 be provided with handle 20 for use as part of the overall carrying case system 10.

Adjustable carrying case system 10 further includes at least a pair of transversely displaced opposing planar members 28 and 30 which are separate and distinct each from the other. Members 28 and 30 are substantially planar in contour within the plane formed by the intersection of transverse and vertical directional arrows 16 and 18. Opposing planar members 28 and 30 are displaced each from the other in transverse direction 14 when cases 12 and 26 are inserted between opposing internal surfaces 32 and 34 of planar members 28 and 30.

Adjustable system 10 further includes support and capture elements 36 for providing simultaneous releasable capturing and supporting of cases 12 and 26 therebetween opposing planar members and 30 as is shown in FIGS. 1 and 2. Each of opposing planar members 28 and 30 include first through passages 38 and 40 aligned each to the other in transverse direction 14 when carrying case system 10 is in its operative mode. Passages or openings 38 and 40 are positioned adjacent lower surfaces 42 and 44 of respective planar members 28 and 30 and are adapted for insert and passage therethrough of support and capture member 36 as will be further discussed. It will be noted that first through passages 38 and 40 lie adjacent lower surfaces 42 and 44, but are positionally removed in an upward vertical direction as defined by directional 16 in order to maintain cases 12 and 26 above a base plane upon which carrying case system 10 may be positionally located. This has the effect of maintaining cases 12 and 26 in a somewhat suspended positional placement when system 10 is located on a base surface and further dictates that the lower surfaces of cases 12 and 26 will not interface in contiguous contact with the base surface which provides for a lessened probability of the lower surfaces of cases 12 and 26 from being scuffed or otherwise damaged.

Improved carrying case system 10 includes a second transversely directed pair of through passages 46 and 48 formed through respective planar members 28 and 30 at a vertical intermediate location of members 28 and 30 defined by vertical directional arrow 16. Additionally, a third set of through openings 50 and 52 are formed in planar members 28 and 30 passing in a transverse direction 14 as is clearly seen in FIG. 2. Third through openings 50 and 52 are positionally located adjacent upper surfaces 54 and 56, but below the vertical extended length of each of members 28 and 30.

Although not important to the structural details of the improved carrying case system 10, planar members 28 and 30 may be constructed of a light weight material such as cardboard, or metal such aluminum of some like material with the only exception being that whatever material is chosen for construction purposes should be structurally sound to prevent failure when impact loaded.

As is seen in FIGS. 1 and 2, support and capture mechanism 36 includes a pair of belts 58 and 60 which pass in a predetermined contour location through first through passages or openings 38 and 40, second through passages or openings 46, 48 as well as third through openings 50 and 52. Belt members 58 and 60 are passed through the openings and in the operative mode provide for an endless loop contour for supporting and constraining cases 12 and 26. Each of belts 58 and 60 include a respective buckle 62 and 64 for maintaining system 10 in a positionally fixed manner when cases 12 and 26 are being transported or otherwise constrained. Buckles or other types of fasteners 62 and 64 may be one of many well known in the art which provide for securement through a frictional grip or impalation. The important aspect of fasteners or buckles 62 and 64 being that once they are lockingly engaged, that such will provide for maintaining belts 58 and 60 in a tensioned manner without providing for release until the user removes such from the locking condition.

Each of belts 58 and 60 include a belt transversely directed portion 66 as seen in FIG. 2 which passes through first through openings 38 and 40 and provides for support of cases 12 and 26 in vertical direction 16. Belts 58 and 60 include first vertically directed sections 68 which pass through openings 38 and 40 and are mounted contiguous external surfaces 74 and 76 of planar members 28 and 30. Sections 68 of belts 58 and 60 pass vertically between first and second openings 38, 40 and 46, 48 as is seen in FIGS. 1 and 2. Second vertically directed section 70 passes contiguous internal surfaces 32 and 34 between second and third through passages 46, 48 and 50, 52 as is seen in FIG. 2. Third vertically directed sections 72 of belts 58 and 60 extend through openings 50 and 52 and pass across upper surfaces 54 and 56 of planar members 28 and 30 to provide an interface at buckle of fastening mechanism 62 and 64. It will be noted that although belts 58 and 60 have been illustratively described in terms of different vertically and transversely directed portions or sections, that belts 58 and 60 are formed in generally one piece construction to provide an endless loop type member when in the operative mode of carrying case system 10.

Belts 58 and 60 are positionally located in longitudinal direction 18 in a manner such that the vertical path of removal of cases 12 and 26 would intersect the transverse positional location of belts 58 and 60. In this manner, when system 10 is being lifted in an upward direction 16 through operator manual use of handle 20, the upper surfaces of either case 12 or another case having the handle member would bear against the inner surfaces of the belts and cause the entire carrying case system 10 to be displaced in the upward direction. It is therefore important that carrying case 12 extend in longitudinal direction in a manner sufficient that its upper and lower surfaces intersect the belts 58 and 60 when in the operative mode.

Figure 3:
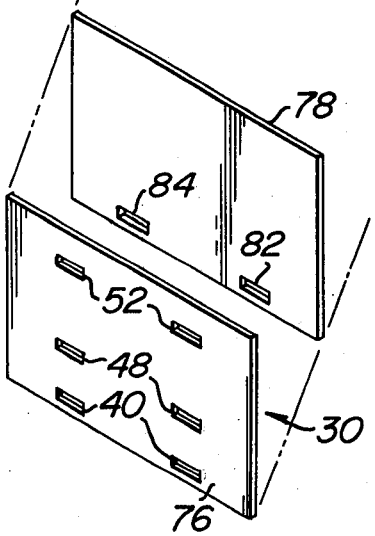
FIG. 3 is a perspective exploded view of a portion of the carrying case system showing one end panel member and an aligned intermediate panel member.

Due to the fact that planar members 28 and 30 are separate and distinct, it will be seen that additional intermediate planar members 78 and 80 may be interspersed between opposing members 28 and 30. Such members as intermediate member 78 may delineate between a plurality of cases 26 and 12 to provide a compartmentalized carrying case system 10. Each of a plurality of intermediate planar members 78 and 80 includes at least one intermediate through passage 82 and 84 which are alignable with first through passages 38 and 40 adjacent lower surfaces 42 and 44 and are adapted such that belt transversely directed portion 66 may pass therethrough. As seen in FIG. 3, since belt members 58 and 60 are not vertically directed in contiguous contact with an intermediate planar member 78, there is no necessity for including second and third sets of transversely displaced through passages as is necessarily formed in opposing planar members 28 and 30.

Provision of through passages 38, 40, 46, 48, and 50, 52 are important in that they provide additional frictional grip of belts 58 and 60 along the internal and external surfaces of planar members 28 and 30. Additionally, it is important to note that the intertwining of belts 58 and 60 through the respective through openings or passages, provides for restrainment of displacement of belts 58 and 60 in longitudinal direction 18. This permits a low probability of movement of belts 58 and 60 when cases 12 and 26 are being transported.

While the invention has been described in connection with preferred specific embodiments thereof, it will be understood that this description is intended to illustrate and not limit the scope of the invention, which is defined by the appended claims.

What is claimed is:

1. An adjustable carrying case system comprising:

a. at least one case having a handle member affixed to an upper surface of said case;

b. at least a pair of transversely displaced opposing planar members being separate and distinct each from the other, said case being insertable between opposing internal surfaces of said planar members, said opposing planar members including (1) at least a first through passage aligned each to the other adjacent a lower surface of each of said planar members, (2) at least a second transversely directed through passage formed at a vertical intermediate location of said planar members, (3) at least a third through opening formed adjacent an upper surface of said planar members; and, c. means for simultaneously releasably capturing and supporting said case between said opposing planar members and said capturing and supporting means, said capturing and supporting means passing through each of said passages and said opening.

2. The adjustable carrying case as recited in claim 1 where said capturing and supporting means includes belt means passing through said first, second and third through passages in an endless loop.

3. The adjustable carrying case as recited in claim 2 where said belt means includes buckle means for securing said belt means in a tensioned manner.

4. The adjustable carrying case as recited in claim 2 where said belt means includes a transversely directed portion passing through said first through passages for supporting said case in said vertical direction.

5. The adjustable carrying case as recited in claim 2 where said belt means includes a vertically directed portion passing (1) contiguous an external surface of each of said planar members between said first and second through passages and, (2) contiguous an internal surface of each of said planar members between said second and third through passages.

6. The adjustable carrying case as recited in claim 2 where said belt means is adapted to pass in said transverse direction over an upper surface of each of said planar members.

7. The adjustable carrying case as recited in claim 1 including at least one intermediate planar member insertable between said pair of transversely displaced opposing planar members for compartmentalizing said carrying case for insert of a plurality of said cases.

8. The adjustable carrying case as recited in claim 7 where said intermediate planar member includes at least one intermediate through passage alignable with a first through passage formed in said pair of planar members adjacent a lower surface thereof and adapted for insert of said capturing and support means.

* * * * *